United States Patent [19]

Theis, Jr.

[11] 4,150,918

[45] Apr. 24, 1979

[54] PRESSURE GAS ENGINE

[75] Inventor: James V. Theis, Jr., Delray Beach, Fla.

[73] Assignee: Hollymatic Corporation, Park Forest, Ill.

[21] Appl. No.: 766,906

[22] Filed: Feb. 9, 1977

Related U.S. Application Data

[60] Continuation-in-part of Ser. No. 651,052, Jan. 21, 1976, abandoned, which is a division of Ser. No. 553,978, Feb. 28, 1975, Pat. No. 3,976,389.

[51] Int. Cl.[2] ..... F01D 5/14; F01D 9/04; F01D 1/02

[52] U.S. Cl. ..... 415/202; 416/197 B

[58] Field of Search ..... 415/202, 92, 56; 416/197 B, 197 R

[56] References Cited

U.S. PATENT DOCUMENTS

| | | | |
|---|---|---|---|
| 269,991 | 1/1883 | Babbitt | 415/202 |
| 584,579 | 6/1897 | Davidson | 415/202 |
| 643,505 | 2/1900 | Igelhorst | 415/202 X |
| 748,678 | 1/1904 | Wolke | 415/56 |
| 812,795 | 2/1906 | Keller | 415/202 |
| 858,500 | 7/1907 | Dake | 415/202 |
| 911,492 | 2/1909 | Goldsborough | 415/56 |
| 979,077 | 12/1910 | Lee | 415/56 |
| 992,433 | 5/1911 | London | 415/56 |
| 992,434 | 5/1911 | London | 415/202 UX |
| 1,525,724 | 2/1925 | Davison | 415/202 X |

FOREIGN PATENT DOCUMENTS

| | | | |
|---|---|---|---|
| 350070 | 7/1905 | France | 415/92 |

*Primary Examiner*—William L. Freeh
*Assistant Examiner*—Donald S. Holland
*Attorney, Agent, or Firm*—Wegner, Stellman, McCord, Wiles & Wood

[57] ABSTRACT

A pressure gas engine in which pressurized gas such as air is supplied to a series of arcuately arranged nozzles for blasting the gas into a single series of closely adjacent impulse buckets in a rotor at its rim. Each bucket lies on a chord of the rim that is adjacent to a tangent to the rim that is parallel to this chord. Each bucket has an arcuate impulse surface of substantially constant radius transverse to the direction of rotation of the rotor and extending from an entrance side of the bucket that is adjacent to one end of the bucket to an opposite exhaust side adjacent to the opposite end of the bucket with each exhaust being subjected to minimum back pressure for maximum efficiency. There is also provided nozzle means comprising an arcuate series of nozzles in the casing around the rotor and closely adjacent to the rim for providing these gas blasts through the nozzles into the buckets for rotating the rotor.

20 Claims, 21 Drawing Figures

Fig. 9
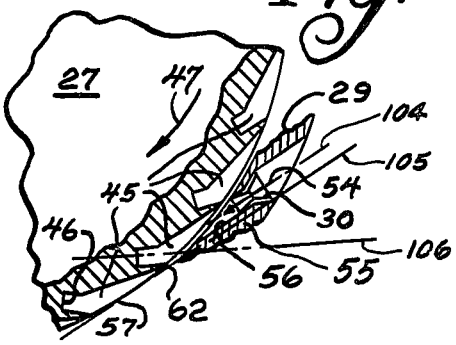
Fig. 8
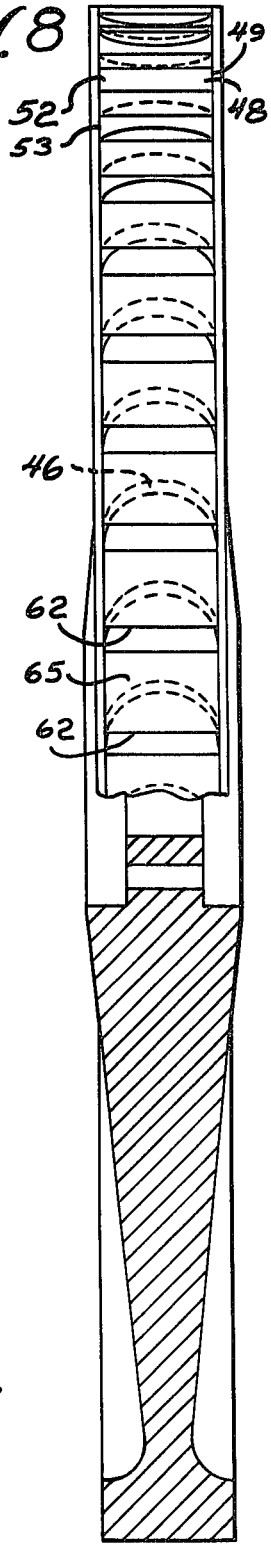
Fig. 10
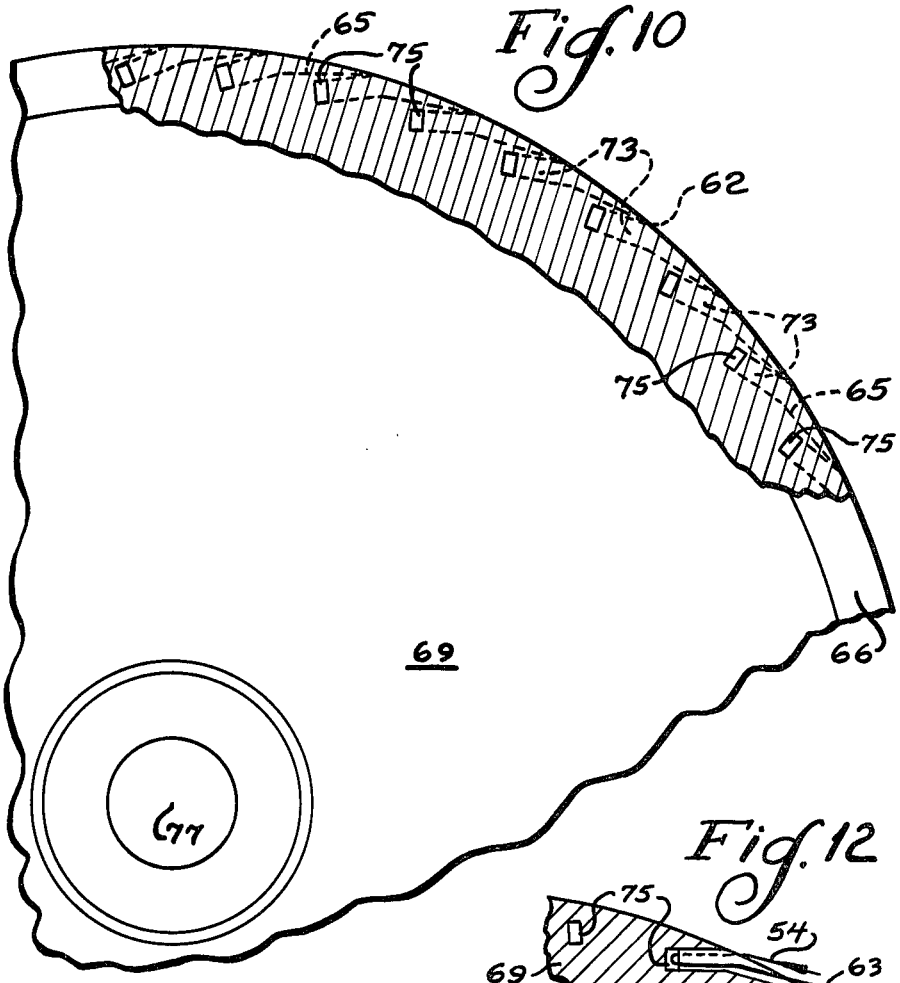
Fig. 12
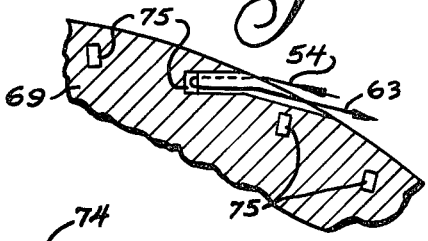
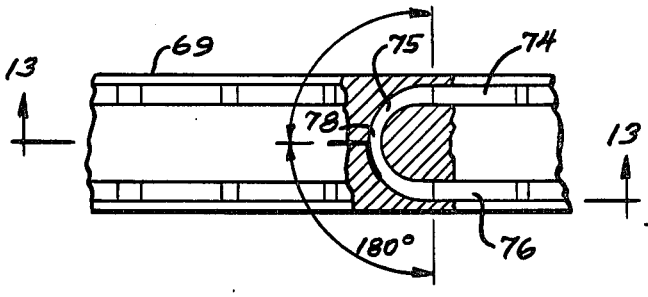
Fig. 11

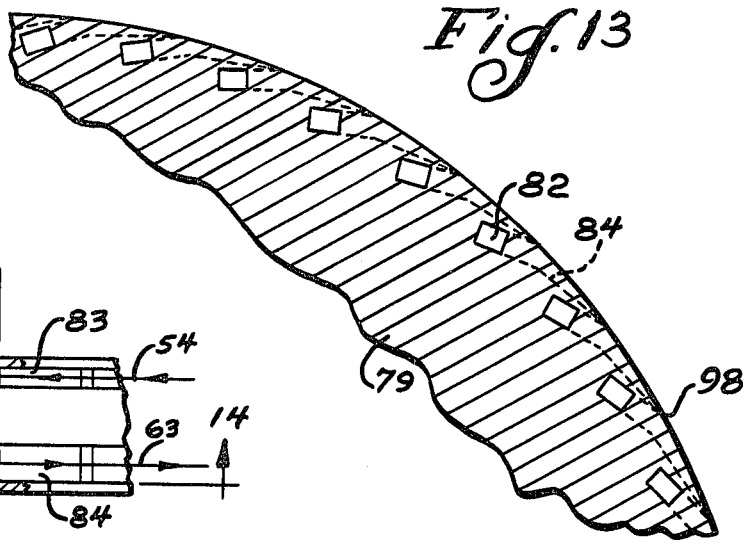
Fig. 13
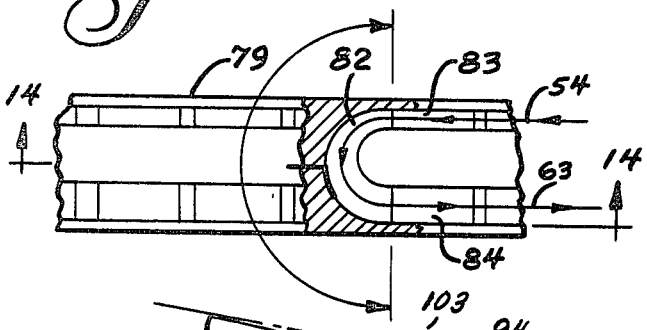
Fig. 14
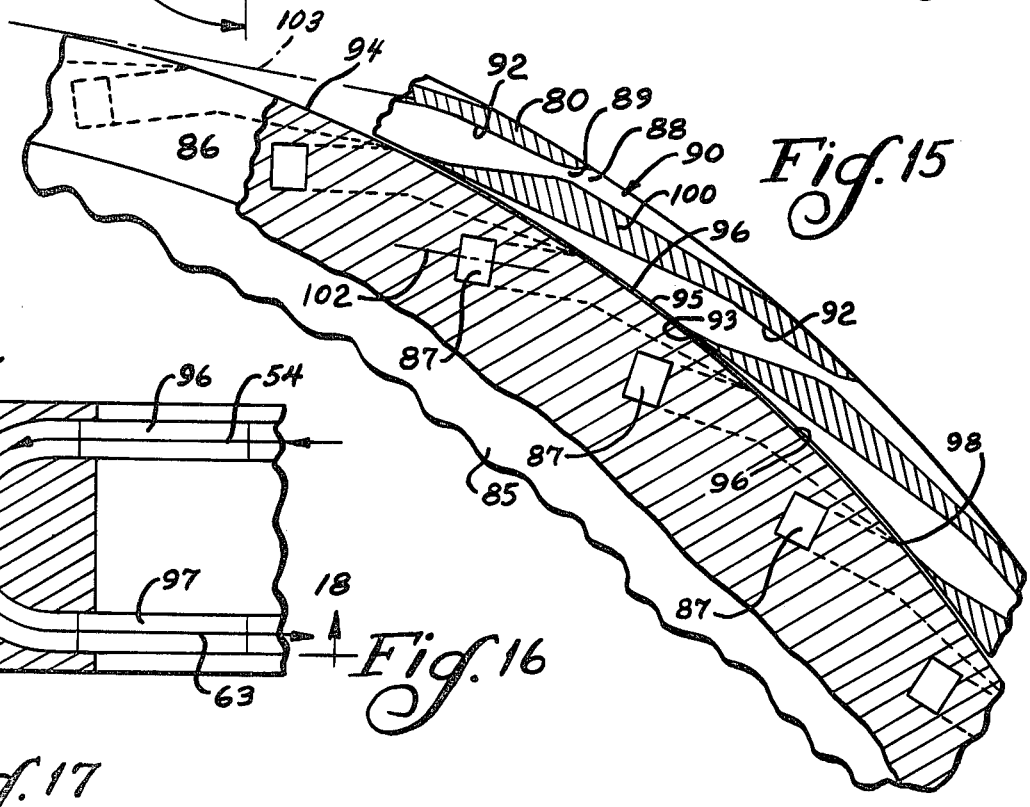
Fig. 15
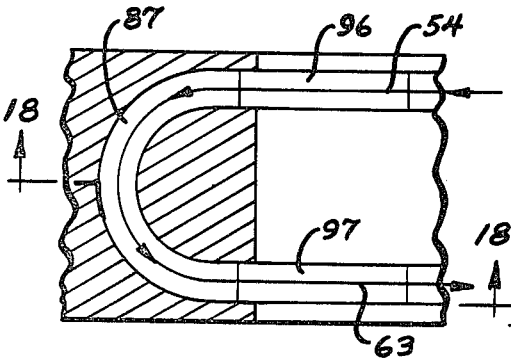
Fig. 16
Fig. 17
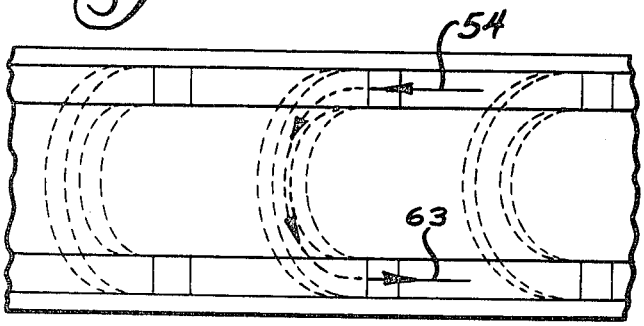
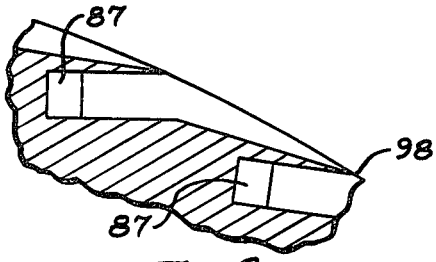
Fig. 18

PRESSURE GAS ENGINE

CROSS REFERENCE TO RELATED APPLICATIONS

This application is a continuation-in-part of my copending application Ser. No. 651,052, filed Jan. 21, 1976, now abandoned, which was itself a division of Ser. No. 553,978 filed Feb. 28, 1975 which issued as U.S. Pat. No. 3,976,389 dated Aug. 24, 1976.

The present application is also related to my prior U.S. Pat. No. 3,930,744 "Pressure Gas Engine", filed Oct. 10, 1973, which contains generic claims.

BACKGROUND OF THE INVENTION

This invention relates to a pressure gas engine in which high velocity gas is blasted from an arcuate series of nozzles toward the rim of a rotor that is closely adjacent to the nozzle exits. This rim at its periphery is provided with arcuate buckets into which these blasts of gas are received. Both the entrances and the exits of the buckets are located at this periphery. The gas after flowing over the arcuate surfaces of the buckets, whch are each arranged on a chord of the rim that is closely adjacent to a tangent to the rim that is parallel to the chord, passes from the bucket exits at very low back pressure so that there is a high efficiency conversion of gas velocity to rotary power.

The pressure gas engine or turbine of this invention contrasts in efficiency of power conversion to the customary reentry type of turbine. These re-entry turbines are the type disclosed in many prior patents including the following: U.S. Pat. Nos. 748,678; 751,589; 845,059; 910,428; 911,492; 979,077; 985,885; 992,433; 1,145,144; 1,546,744 and 3,197,177.

It has been discovered that by providing a straight through passage of the gas from the nozzles through the buckets and into a volumetric section of low fluid back pressure a major improvement in performance is achieved. This is true for many reasons. For example, in the re-entry impulse type of turbine where the gas flows successively through a series of re-entry stages the relative velocity of the fluid passing from one reentry stage to the next constantly decreases while the density of the gas remains constant. Consequently, as the velocity of the gas flowing through the re-entry passages and buckets decreases the cross sectional area of the gas flow increases in inverse proportion.

Attempts have been made in the past to solve this problem of increasing cross sectional area of the gas stream with decreasing speed from one re-entry stage to the next by providing an escape path for some of the gas stream before all of its kinetic energy is converted to power on the re-entry. However, this has not been satisfactory so that such re-entry stage turbines have never been very efficient. Further, the high velocity gas which actually makes a full trip through the successive re-entry stages is subject to a multitude of effects resulting from the long and tortuous path that the gas must take in the re-entry stages and the resulting improper relative angles of entry of the recirculating gas to the rotor which is traveling at constant speed. This type of path tends to convert the kinetic energy of the gas stream to heat rather than to work on rotating the rotor.

In contrast, the turbine of this invention does not subject the high velocity gas to a long path to convert its energy to shaft horsepower in the rotor but goes contrary to these prior teachings in providing the shortest possible path from the nozzles through the buckets to the exhaust area. Many tests have shown that this elmination of the re-entry stages of the prior art coupled with a corresponding increase in turbine rotor rim speed greatly improves the efficiency of the engine. This efficiency is defined as the conversion of the potential energy of the compressed gas to shaft horsepower and with the engine of this invention is much greater than has been achieved before to the best of my knowledge.

SUMMARY OF THE INVENTION

In this invention the engine comprises a rotor in a casing with the rotor having a circular rim rotatable about an axis of rotation. At the rim periphery there is provided a single series of closely adjacent impulse buckets with each bucket lying on a chord of the rim that is adjacent to a tangent that is parallel to this chord. Each bucket has an arcuate impulse surface of substantially constant radius transverse to the direction of rotation of the rotor and extending from an entrance side of the bucket at the rim periphery to an opposite exhaust side of the bucket that is at the rim periphery.

The engine also includes an arcuate series of gas nozzles around and partially or completely surrounding the rotor. They are closely adjacent to the rotor rim periphery with each nozzle having an axial gas passage providing a high velocity, and preferably supersonic, blast of gas relative to the nozzle exit into the buckets.

Each nozzle exit is located at and substantially linearly aligned with the bucket entrances during rotation of the rotor and there is also provided a blast directing means for directing substantially all of the nozzle blasts directly into the bucket entrances for flow over the impulse surfaces and from the bucket exits.

In the preferred construction each arcuate impulse surface of each bucket, whether the bucket is open or tubular, extends for about 180° between the entrance and exhaust sides. Also, in the preferred construction the nozzles are of rectangular cross section at all points along the central axis thereof and the buckets are also preferably of rectangular cross section. The nozzles are so arranged that each nozzle has a central axis that is on a chord of the rotor that is closer to a tangent to the rotor rim than is the plane of the impulse surface of each bucket.

In one construction the circular rim of the rotor is provided with a flat substantially square recess outwardly of and adjacent to each bucket with each flat recess being located in alignment with its bucket entrance and exit sides and with the square extending between the opposite side extremities of the buckets.

BRIEF DESCRIPTION OF THE DRAWINGS

FIG. 8 is a partial sectional view through the rotor of FIG. 7.

FIG. 9 is a fragmentary sectional view of the engine embodiment in the vicinity of the rotor and nozzle plate and illustrating schematically a single nozzle.

FIG. 10 is a fragmentary side elevational view partially in section of a further embodiment of the rotor.

FIG. 11 is a fragmentary sectional view illustrating this further embodiment of the rotor of FIG. 10.

FIG. 12 is a fragmentary sectional view taken substantially along line 12—12 of FIG. 11 showing flow of the gas blast relative to a rotating bucket.

FIGS. 13 and 14 are similar to FIGS. 10 and 11 but illustrating a further embodiment.

FIG. 15 is an enlarged sectional view through a portion of the rotor and the surrounding nozzle plate of an embodiment of the invention and illustrating tubular buckets and converging-diverging nozzles.

FIG. 16 is a view similar to FIG. 14 but illustrating yet another embodiment.

FIG. 17 is a plan view of a portion of the rim of the rotor of FIG. 15 illustrating a series of three tubular buckets.

FIG. 18 is a detail sectional view taken substantially along line 18—18 of FIG. 16.

DESCRIPTION OF THE PREFERRED EMBODIMENTS

Figure 1:
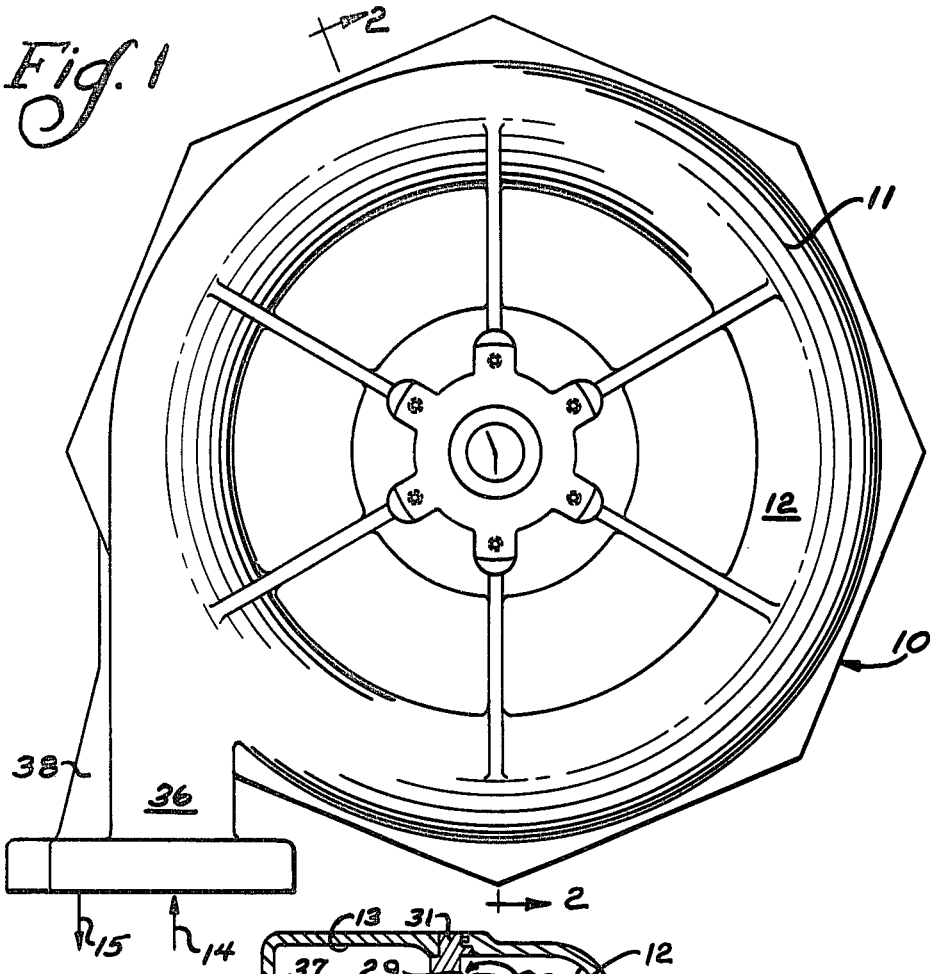
FIG. 1 is a side elevational view of a pressure gas engine embodying the invention.

In the embodiment of FIGS. 1–4 the gas engine 10 comprises a casing 11 comprising two halves bolted together with one comprising an entrance scroll side 12 and the other an exit scroll side 13. The gas as shown at 14 enters the entrance scroll, passes through the nozzles and buckets and exits from the engine as shown by the arrow 15.

Held in the casing 11 is a drive shaft 16 supported on spaced ball bearings 17 and the entrance scroll side 12 has projecting therefrom an axial tubular extension 18 to which the shaft 16 is sealed by a pressure deformable seal 19.

The opposite end 22 of the shaft 16 which is opposite the seal 19 is enclosed within a cap 23 bolted to the casing 11 as by bolts 24. The shaft 16 has an end portion 25 adjacent to but spaced inwardly of the extreme end 22 and provided with an annular flange 26 to which is bolted a circular rotor 27 as by a series of bolts 28. The drive shaft 16, the tubular extension 18, the seal 19, the cap 23 and the rotor 27 are all coaxial about a central axis of rotation 23.

Figure 2:
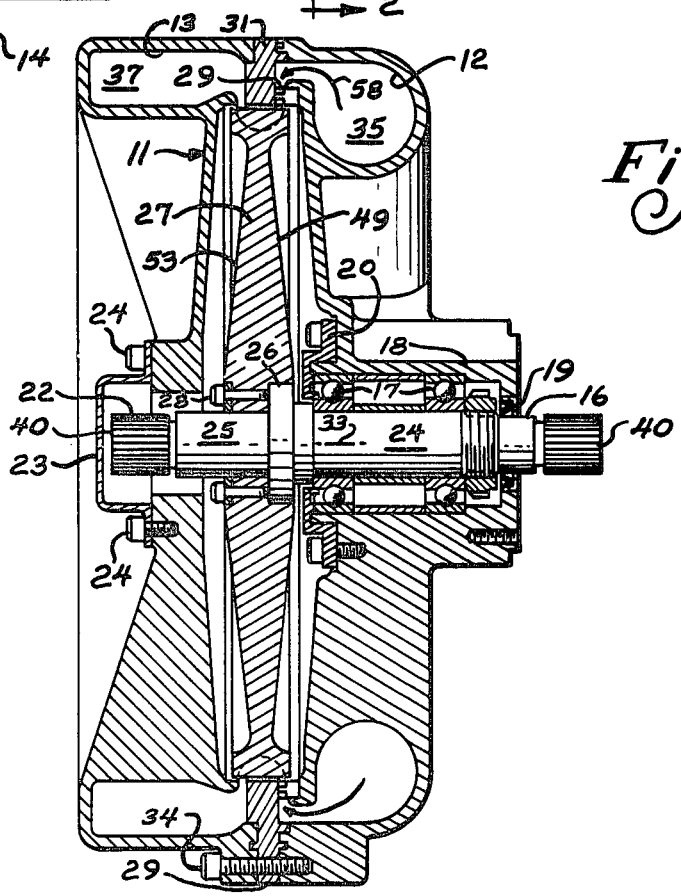
FIG. 2 is a sectional view taken substantially along line 2—2 of FIG. 1.
Figure 3:
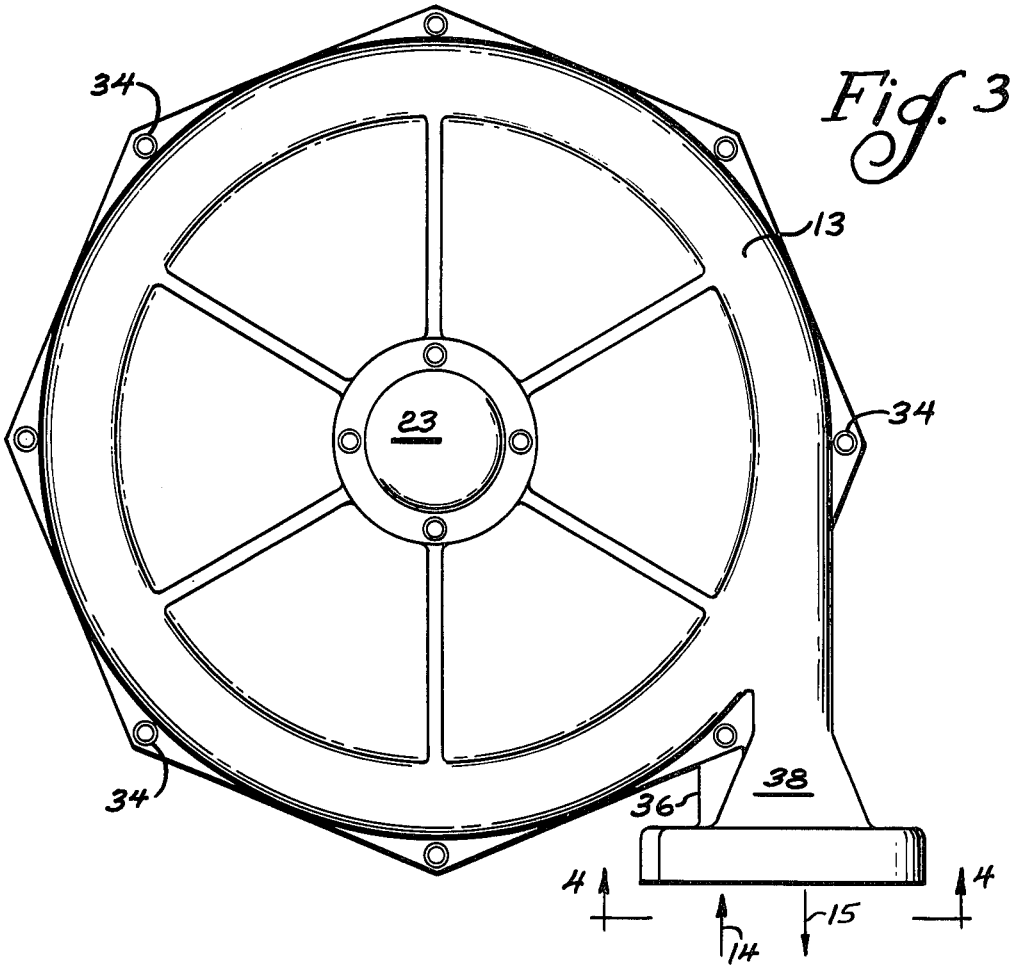
FIG. 3 is a side elevational view taken from the opposite side of FIG. 1.
Figure 4:
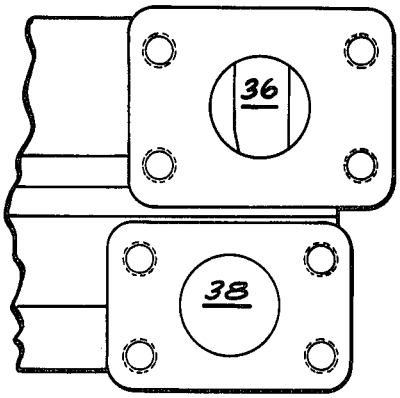
FIG. 4 is a bottom view of the embodiment of FIG. 3 looking up from line 4—4 of FIG. 3.
Figure 6:
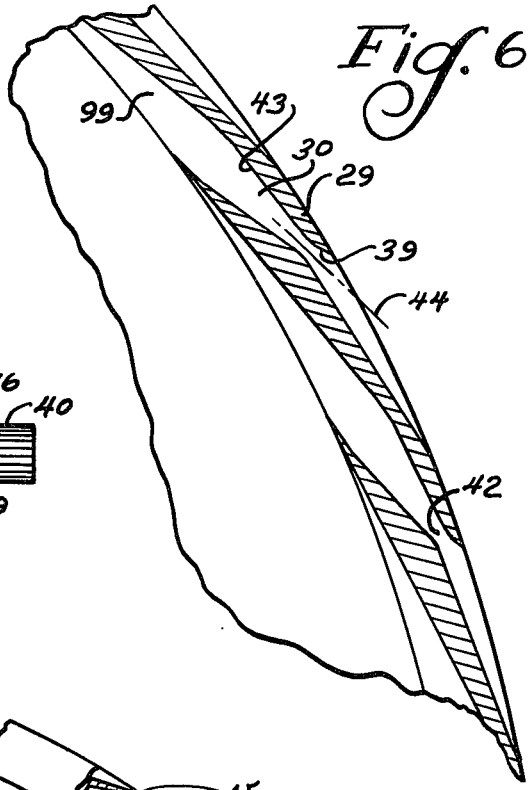
FIG. 6 is a fragmentary side elevational view partially broken away and partially in section of one embodiment of a nozzle plate of the engine.

Between the entrance side 12 and the exit side 13 of the casing 11 there is provided an annular nozzle plate 29 that contains a closely adjacent series of nozzles 30 as shown in the detail nozzle plate sectional view of FIG. 6. The side plates 12 and 13 and the nozzle plate 29 are held in assembled relationship as shown in FIG. 2 by a peripheral series of bolts 34.

The entrance scroll side 12 has a large volume scroll passage 35 leading from an entrance extension 36 for flow of the entering gas 14. The exit scroll side 13 which is assembled in facing relationship with the side 12 and with the nozzle plate 29 therebetween, as explained above, contains a large volume scroll 37 leading to an exit extension 38 for the exiting gas 15.

As is shown in FIGS. 6 and 9, each nozzle 30 of this embodiment has a converging entrance 39, a throat 42 and a diverging exit 43 that define an axial gas passage for providing a high velocity blast of gas into the rotor buckets. This gas blast 54 which is ordinarily supersonic relative to the nozzles, in this embodiment, lies along the central axis 44 of each nozzle 30.

Figure 7:
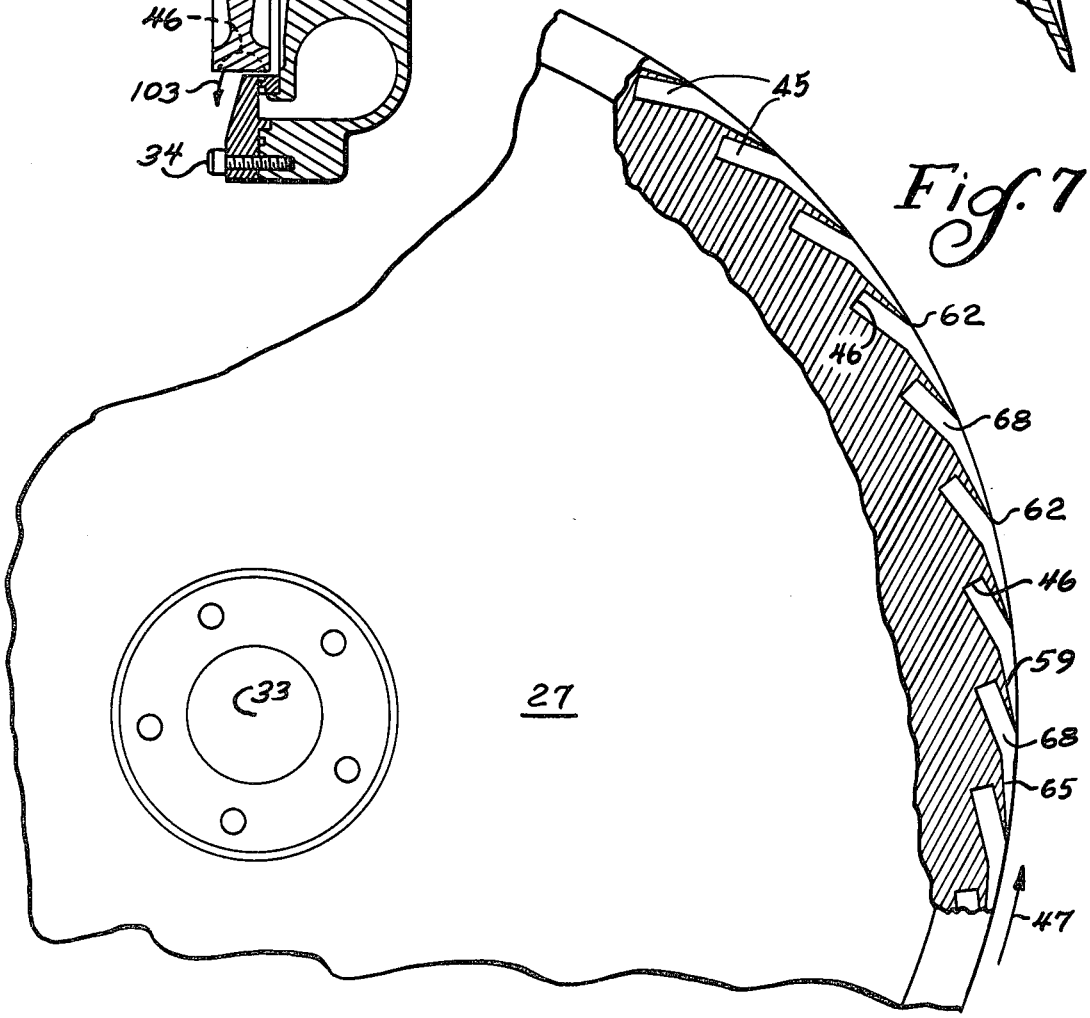
FIG. 7 is a side elevational view partially in section of an embodiment of the rotor of the engine.

As shown in the rotor embodiment of FIGS. 7 and 8, the rotor 27 is provided with a single series of closely adjacent impulse buckets 45 with each bucket having an arcuate impulse surface 46 of substantially constant radius transverse to the direction 47 of rotation of the rotor 27. These bucket surfaces 46 extend from an entrance side 48 of each bucket that is adjacent one side 49 of the rotor to an opposite exhaust side 52 that is adjacent the opposite side 53 of the rotor. The gas blast 54 enters each bucket at its entrance side 48 for substantially unrestricted flow around the arcuate impulse surface 46 and from the exhaust side 52 of each bucket.

As can be seen in FIG. 2, each exhaust side of each bucket exhausts directly into a volumetric section of low gas back pressure as illustrated by the exit scroll passage 37 of large cross sectional area and the similarly large exit extension 38. The back pressure is defined as pressure equal to or greater than the design nozzle blast pressure illustrated at 54 in FIG. 9. This blast pressure in many cases is substantially equal to ambient atmospheric conditions. However, blast pressures of 50–100 psig or more may be desirable in certain installations in which case the low back pressure would be correspondingly greater.

The nozzle means comprises the nozzle plate 29 and the arcuate series of nozzles 30 each providing a high velocity blast of gas. The nozzle plate is retained in position by a nozzle plate retainer ring 31 (FIG. 2). Each end of the shaft 16 is provided with a spline drive 40 and surrounding the shaft 16 inwardly of the ball bearings 17 is a bearing cap and grease seal 20.

The nozzle means also comprises a blast directing means (FIG. 9) for directing substantially all of each blast 54 directly into the bucket entrances 48 for flow over the impulse surfaces 46 and from the bucket exits or exhaust sides 52. This blast directing means includes a flow directing member 55 which is an integral part of the nozzle plate 29 locating the outer boundary of the gas blast 54 at the surface 56. This boundary surface 56 and thus the outer boundary of each gas blast is substantially at a tangent to the rotor periphery 57 as illustrated in FIG. 9.

As can be seen in FIG. 9 each nozzle 30 has a central axis 104 that is on a chord (to the rotor 27) that is generally closer to a tangent 105 (to the rotor periphery 57) that is parallel to the chord 104 that is the plane 106 of the impulse surface 46. Thus, as can be seen in FIG. 9, the nozzle central axis 104 is very close to and parallel with a rotor tangent 105 but is angularly spaced from the plane 106 of the corresponding impulse surface 46. Thus although the nozzle axis 104 and the plane 106 intersect adjacent to the rotor rim 57 they are actually widely spaced apart except in the vicinity of the intersecting.

The gas entrance extension 36 and the entrance scroll passage leading to the nozzle entrances as illustrated by the gas flow arrow 58 comprise means for supplying the pressurized gas to all of the nozzle means 30 while the exit scroll 37 and the exit extension 38 comprises means for exhausting spent gas.

As is illustrated in FIG. 7 the adjacent buckets 45 are separated from each other by a wall means 59 forming an integral part of the rotor 27 with each wall means having a thin edge 62. This thin edge which, of course, is tapered as shown in FIG. 10 divides the gas blast 54 for flow into adjacent buckets 45 as the thin edge passes the nozzle exits 43. As is shown in FIGS. 7 and 8 the inner surface 65 of each bucket 45 that is closer to the axis of rotation 33 is convexly recessed so that the nozzle blast 54 across this surface provides a low pressure airfoil-like surface adding to the rotational torque developed by the rotor. The central nozzle axis 44 which for purposes of illustration in FIG. 9 coincides with the arrow 54 indicating the gas blast lies on a chord that is generally closer to a tangent to the rim or periphery 57 of the rotor than is the plane of the impulse surface 46 of each bucket.

The large volume gas flow passages 36, 35, 37 and 38 permit relatively free flow of gas to the nozzles 30, through the rotor buckets 45 and from the buckets after the pressurized gas has acted upon the rotor. The gas thereby rotates the rotor in a very efficient way and at the same time greatly reduces the gas temperature through expansion of the gas so that the exiting gas 15 is much cooler than the supply gas and may actually produce a refrigerating effect.

Each nozzle exit 43 is linearly aligned with each bucket entrance 48 during rotation of the rotor. In the preferred engine or turbine, as illustrated, each bucket 45 has an impulse surface 46 extending for about 180° so that when the rotor 27 is in the position shown in FIG. 9, for example, the high velocity gas 54 from each nozzle 30 enters each bucket at an entrance side 48, flows around the impulse surface 46 and then leaves the bucket at the exhaust side 52. This 180° is shown in FIGS. 2, 5, 8, 11, 14, 16 and 17. The flow of pressurized gas over these impulse surfaces 46 is thereby also for about 180° with the gas completely reversing itself as illustrated in FIGS. 14, 16 and 17. The very high efficiency of operation and the very high horsepower developed per unit of gas flow rate are caused by a combination of the above 180° flow of the gas relative to the rotor, the entering of the gas into the buckets as close to rotor tangent as possible and the insuring of this tangent flow of gas by providing the blast confining wall surfaces 56 (FIG. 9) for each nozzle.

Thus a 4.75 inch diameter turbine embodying this invention and supplied with air at 100 psig and 80° F. at the turbine inlet produces 7 horsepower at an air consumption of 105–120 SCFM. The turbine therefore used only 15–17 standard cubic feet per minute of air per minimum flow rate per shaft horsepower developed. This is believed to be about one-half or less of the flow rate per horsepower achieved in conventional impulse gas turbines under these conditions.

In the preferred construction as illustrated the flat surface 65 leading to each bucket 45 is sloped toward the bucket impulse surface 46 as shown for example in FIG. 7. This sloped surface 65 is approximately square in plan view with the transverse dimension being defined substantially by the bucket diameter and the length of this surface defined by the distance between successive narrow sharp edges 62. In one example of a 4.75 inch diameter of 0.562 inch wide rotor thirty equally spaced buckets 45 were provided in the rim 66 of the rotor 27 and twenty equally spaced nozzles 30 in a surrounding nozzle plate 29.

It is believed that the principal causes for the high efficiency of this engine and the high horsepower per unit gas flow is a converting of the pressure gas to dynamic gas flow 54, the directing of substantially all of each blast of gas into the buckets 45 substantially tangentially to the rotor, the sweeping of the gas blast across the arcuate impulse surfaces 46 and from there out the exit or exhaust side 52 of each bucket with both the entering gas blast 54 and the exhaust gas flow illustrated at 63 in the embodiment of FIG. 12, which is common to all embodiments, substantially on a tangent to the rotor and substantially parallel to each other and at right angles to the axis of rotation 33 into a non-restrictive exhaust port.

The high performance of this turbine is believed to be partly achieved by reducing the speed of the nozzle blast illustrated at 54 relative to the ground to as low a value as possible as a result of its path through the rotating turbine buckets.

Another very important and contributing factor to the high efficiency and high horsepower per unit gas flow achieved appears to be the directing of the exhaust gas with substantially no flow restraining obstructions away from the rotor. This is achieved by having the exit scroll passage 37 and the exit extension 38 restriction free and of large cross sectional area.

The boundary surface illustrated at 56 directs the gas blast which has a finite thickness so that the entire thickness of the blast crosses the periphery 57 of the rotor 27 at a small angle which is as close to tangent to the rotor as possible.

A graphic example of the theory of the problems overcome by the impulse turbine or pressure gas engine of this invention can be seen in contrasting the well known Pelton wheel type hydraulic turbine. A typical turbine of the Pelton wheel type could be supplied with water at a heat of about 1500 feet as by a dam of this height. The nozzle would then eject water at a speed of about 300 feet per second relative to the ground to impact on buckets moving at about 150 feet per second relative to the ground. Under those conditions, a peak efficiency of 93% could be expected including an expected 7% loss. Part of this 7% loss in efficiency is due to the acceleration of the air surrounding the Pelton wheel engine by the fan-like effect of the impulse buckets in the rotating rotor which are moving at about 100 miles per hour. As atmospheric air has only 0.1% the density of water, approximately, it can be seen that if the Pelton wheel were operating with the rotor submerged in its own working fluid, namely water, instead of the much less dense air there would be a disasterous loss in performance because of the greater density and therefore drag on the rotating wheel. This loss would be primarily due to the acceleration of the water surrounding the wheel by the impulse buckets acting on the wheel.

The rotor 27 of this invention operating submerged in air or gas, if a gas other than air is used, provides a rim speed of rotation 47 relative to the ground approaching one-half the nozzle blast 54 speed. At peak efficiency for a preferred converging-diverging nozzle supplied with air at 80° F., 100 psig exhausting to atmosphere, the nozzle blast 54 speed relative to the ground will reach about 1600 feet per second. The rim speed of the rotor relative to the ground will approach about 800 feet per second at peak efficiency. The bucket edges 62 will therefore have a speed relative to the air in which they are submerged of 800 feet per second. This air may become quite cold, as low as −125° F. or even lower. Under these conditions the local Mach number of the surrounding air relative to the rim is nearly one. As with a Pelton wheel submerged in water, it is possible to suffer great efficiency losses if the buckets significantly accelerate the surrounding air but the open impulse buckets of this invention reduce the windage or pumping losses associated with circulation of atmospheric and exhaust air by the rotor and the rotor buckets.

It has also been found that the dynamic losses associated with partial flow and full flow operation of the turbine may be further reduced by providing a bucket passage which is only as large in cross sectional area as is required to contain the blast 54 from the nozzles 30 relative to the bucket passage. This is achieved in the illustrated embodiments of FIGS. 10–18 (to be described hereinafter) which illustrate tubular buckets. This reduction of dynamic losses in the tubular buckets is believed to be due to the elimination of the open volume of the bucket which is that area illustrated at 68 in FIG. 7 as this area is not needed to convert the gas blast to shaft horsepower as this is done by the gas blast 54 sweep over the arcuate impulse surfaces 46. this aerodynamically unnecessary volume of the bucket may comprise 50% or more of the entire bucket 45 volume. During high speed this unused open space tends to interact with the gaseous atmosphere surrounding the rotor and thus the buckets thereby cause dynamic losses due to the fan-like effect of the unused open space on the surrounding atmosphere. By providing the tubular buckets 73 this unused open space is eliminated and thus during full flow conditions the gas surrounding the rim 66 of the rotor no longer flows inwardly of the rotor periphery to interact with the open bucket surfaces.

An embodiment of the tubular bucket rotor is shown in FIGS. 10–12. Here the rotor 69 has located in its peripheral rim 66 a series of buckets 73 that are the same as the buckets 45 of the first embodiment except each is tubular with an entrance 74 for receiving the gas blast 54, an arcuate tubular impulse section 75 and a tubular exit 76. Both the tubular entrance 74 and exit 76 are substantially parallel to each other, lie on approximately equal chords as close to tangent as possible to the rotor rim, and are at right angles to the axis of rotation 77 of the rotor 69. In this embodiment the width of the tubular impulse section 75 decreases or converges to about the center 78 of the bucket and then increases in section width or diverges to the exit.

In the embodiment of FIGS. 13 and 14 the rotor 79 also contains a series of tubular buckets 82 similar to those in the last previous embodiment but here each bucket is diverging in that it increases in width gradually and uniformly from the entrance 83 to the exit 84.

In the embodiment of FIGS. 15–18 there is disclosed in enlarged detail the relationship of the nozzle plate 80 to a rotor 85 having a rim 86 provided with a series of tubular buckets 87. Each of these buckets so far as the tubular configuraion is concerned is similar to those of the embodiment of FIGS. 10-12 and in all other respects to the open buckets 45 of the first embodiment. Thus each nozzle 90 in this embodiment has a converging entrance 88, a restricted throat 89 and a diverging exit 92 with all exits having a common inner periphery 93 that is circular and very closely adjacent to the outer periphery 94 of the rotor 85. Here, as in the other embodiments, the nozzles 90 are of rectangular cross section. This embodiment in FIG. 15 shows how the outer limit 95 of each nozzle exit 92 spans more than one bucket entrance 96. Thus in the illustrated embodiment, there are 45 buckets and 30 nozzles. In this embodiment the buckets 87 are of uniform width from the entrance 96 around the full 180° sweep of the buckets 87 and through the exit 97. The plane of the inpulse surfaces of the buckets 87 is indicated by the line 102 in FIG. 15.

The tubular bucket structure as illustrated in these embodiments of FIGS. 10–18 is preferred because it improves the conversion of the kinetic energy of the gas blast to shaft 16 horsepower in two principal ways. First, this construction further reduces the power required to spin the rotor at a speed required for the most efficient conversion of the kinetic energy of the nozzle blast 54 to horsepower, by reducing windage losses on the rim, and second, by providing a tubular guide for the gas blast as it changes directions in the bucket passage gas velocity losses are minimized so that the force exerted by the blast passing through the bucket is increased and more nearly approaches the maximum that can be achieved.

Another very important feature of the tubular bucket construction which improves the efficiency of operation of the turbine is the greatly increased strength of the tubular bucket when compared to the open style bucket of the embodiment of FIGS. 1–9. This greatly increased strength is the result of significantly shortening the unsupported span of the bucket surface at the entrance just inwardly of the sharp bucket separating edge 98 which is similar to the sharp edge 62 in the first embodiment that separates the adjacent buckets. In the open arrangement of the first embodiment this span is equal to the diameter of the substantially radial impulse surface 46. However, in the tubular bucket embodiments the span is supported for a substantial distance between the entrances and the exits of the buckets. Thus when a gas such as steam, natural gas at high pressure or air at elevated temperatures and pressures is used, the rotor with the tubular buckets may be operated at much greater rim speeds required to convert efficiently the kinetic energy of the resulting high velocity nozzle blast to shaft horsepower.

In all embodiments in order to direct all of the gas blast from each nozzle completely into each bucket for sweep across the respective impulse surface the exit or exhaust end of each nozzle should be substantially no greater in width than the width of the entrance of each bucket.

In addition, the provision of only a single row of buckets comprising a single stage as illustrated in all embodiments with no re-entry and with relatively free flow exit from the buckets makes an important contribution to the very high efficiency achieved.

The provision of the flow directing member illustrated at 55 in the first embodiment of FIG. 9 and at 100 in FIG. 15 and which is also shown in all other embodiments confines the gas blast (e.g. 54) on three sides with only the rotor side being exposed so that all of the gas blast is directed to the rim of each rotor at the periphery thereby preventing any gas from being redirected out of the bucket by contact of the gas with the adjacent rotating surface of the buckets. This confinement of the gas blast is of particular importance in the tubular bucket construction as it insures that substantially all of each gas blast enters the buckets at the proper angle and that all the gas passes over the arcuate inpulse surfaces of the buckets (illustrated at 46 in the first embodiment) so as to utilize the entire flow of the bucket. These three confining sides of each flow directing member 55 comprise the outer wall surface illustrated at 56 and opposite parallel confining sides 99 (FIG. 6). These confining sides further prevent sideways dissipation of the energy of the blast.

Figure 5:
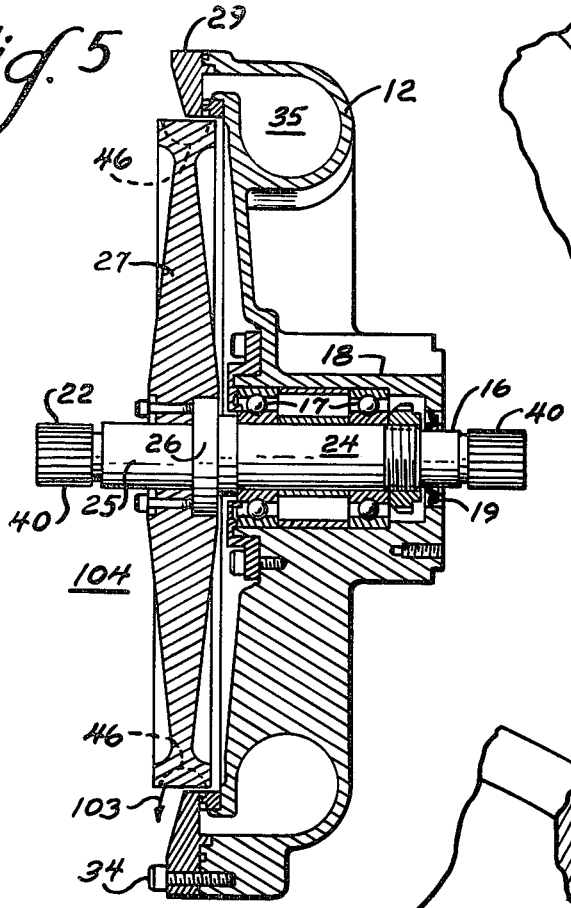
FIG. 5 is a view similar to FIG. 2 but illustrating another embodiment of the invention.

FIG. 5 illustrates an embodiment which is exactly the same as the embodiment of FIGS. 1–4 except that here the exit scroll side 13 is omitted permitting the exit gas flow 93 to pass directly to the exterior 104 without going through an exit scroll.

Arrow 103 in FIG. 5 illustrates the path of flow of the pressurized gas exhausting from the rotor after contact with the impulse surfaces 46.

Figure 19:
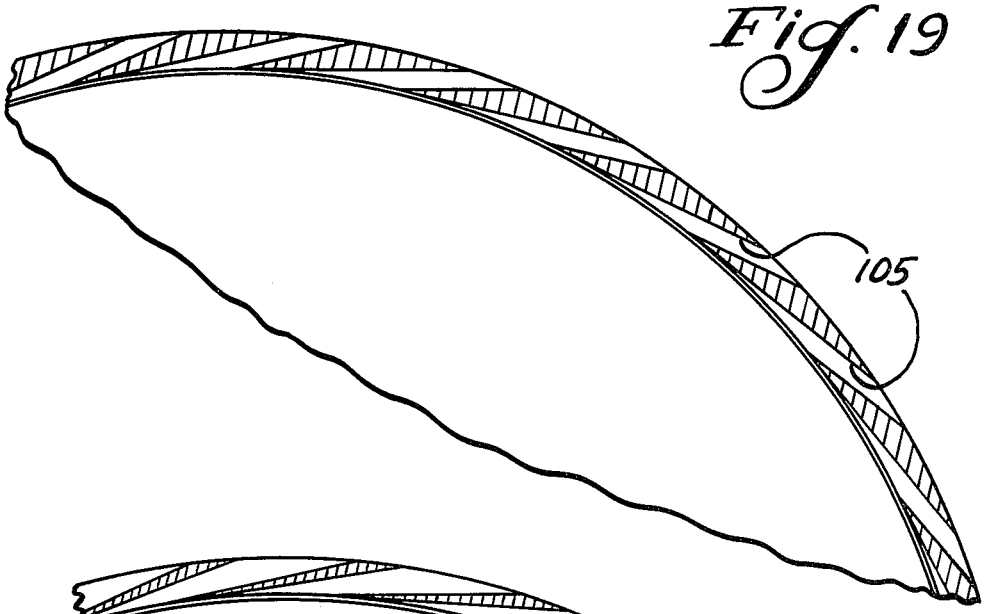
FIGS. 19–21 are each fragmentary sectional views illustrating different embodiments of nozzle plates.
Figure 20:
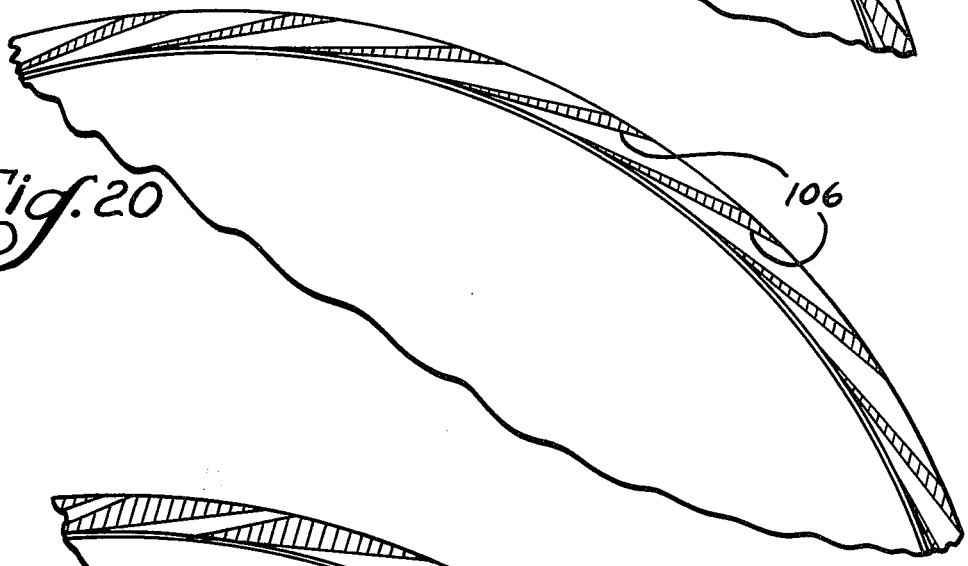
Figure 21:
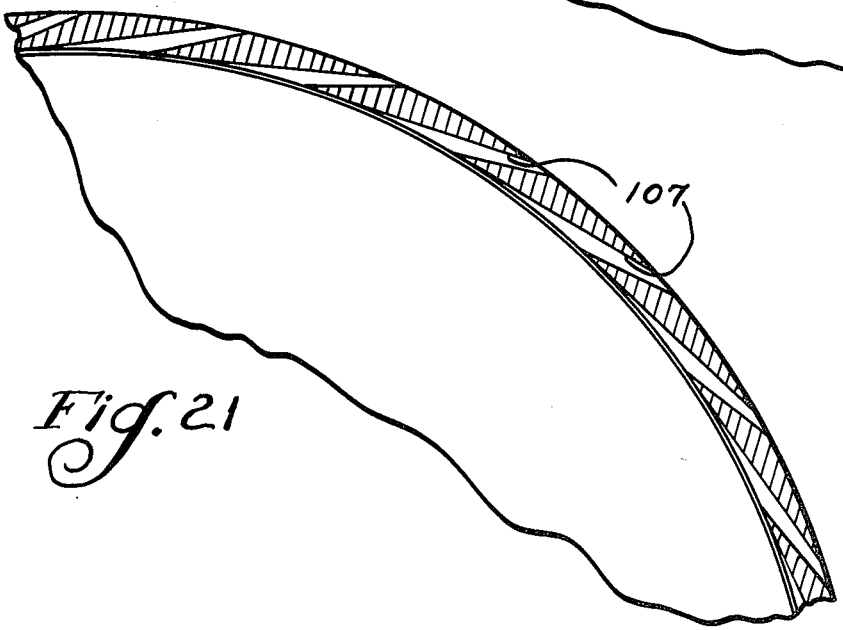

FIG. 15 illustrates a typical converging-diverging nozzle plate 80. In this plate the converging entrance 88 is at a 32° angle, the throat 89 is 0.031 inch long and the diverging exit 92 is at a 15° angle. Although the converging-diverging shape of each nozzle is preferred because of the resultant high speed gas blast which may be as great as supersonic the turbine can also be used with other shape nozzles to produce very high efficiency. Thus in the FIG. 19 embodiment the nozzles 105 have parallel tops and bottoms which in FIG. 20 the nozzles 106 are converging toward the rotor and in FIG. 21 the nozzles 107 are diverging toward the rotor.

As can be seen in FIG. 15, the plane of impulse 102 from each bucket, and along which each bucket lies, is also a chord of the rotor rim 86. This chord is adjacent to a tangent 103 to the rim 86 that is parallel to the chord 102.

As mentioned earlier, one of the reasons for the high efficiency, as expressed in cubic feet per minute per horsepower, of the engine or turbine of this invention is that the pressurized gas is not subjected to a long travel path as is the case with the re-entry type system to convert the gas energy to shaft horsepower. This invention rather provides as short as possible a path of travel of the gas through the buckets and exhausts the gas immediately into an area of relatively low gas pressure so as to avoid excess back pressure.

Although several statements of theory have been made herein, the invention is not to be limited by any of these.

I claim:

1. A pressure gas engine, comprising:

(1) an enclosing casing having a gas flow exhaust comprising gas flow outlet openings of low back pressure relative to the absolute pressure of the blast;

(2) a rotor in said casing having a circular rim defined by an outer periphery and rotatable about an axis of rotation;

(3) a single series of closely adjacent impulse buckets in said rotor at said periphery with each bucket having an entrance and exit, (a) each said bucket lying on a chord of said rim that is adjacent to a tangent to the rim that is parallel to said chord, (b) each said bucket having an arcuate impulse surface of substantially constant radius transverse to the direction of rotation of said rotor, said arcuate surface extending from an entrance side of said bucket located at said periphery to an opposite exhaust side of the bucket also located at said periphery, (c) each said exhaust side exhausting directly into said gas flow exhaust of said relatively low back pressure;

(d) said circular rim being provided with a flat substantially square recess outwardly of, and adjacent to, each said bucket and said flat recess being located in alignment with the bucket entrance and exit sides, the square extending between the outer extremities of said entrance and exit sides of its respective bucket (4) nozzle means comprising an arcuate series of gas nozzles in said casing closely adjacent to said rim, each said nozzle having an axial gas passage substantially aligned with said entrance sides during rotation of the rotor for providing a high velocity blast of gas through each said nozzle, through said buckets and directly into said gas flow exhaust in a single pass through said buckets, (a) said nozzle passages being located at and substantially linearly aligned with said bucket entrances and said nozzle means comprising blast directing means for directing substantially all of each said nozzle blasts directly into said bucket entrances for flow over said impulse surfaces and from said bucket exits, said gas blast thereby entering and leaving said rotor at said rim periphery, (b) the blast directing means including a flow directing member locating the outer boundary of each said gas blast at said periphery; and (5) means for supplying pressurized gas to all said nozzle means.

2. The engine of claim 1 wherein said gas passages converge from an entrance to an exit leading to said bucket entrances.

3. The engine of claim 1 wherein said gas passages diverge from an entrance to an exit leading to said bucket entrances.

4. The engine of claim 1 wherein said gas passages are of uniform cross section from an entrance to an exit leading to said bucket entrances.

5. The engine of claim 1 wherein said gas passages converge and then diverge from an entrance to an exit leading to said bucket entrances.

6. The engine of claim 1 wherein said gas flow outlet openings comprise means for substantially preventing restriction to said gas flow through said openings relative to the gas flow of said blast of gas.

7. The engine of claim 1 wherein said arcuate impulse surface of each bucket extends for about 180° between its said entrance and exhaust sides.

8. The engine of claim 1 wherein said blast directing means comprises an outer wall extending from the corresponding nozzle exit toward said rotor rim.

9. The engine of claim 1 wherein said buckets are each separated from an adjacent bucket by a wall means comprising tapered edge means for dividing said blast of gas for flow into said adjacent buckets.

10. The engine of claim 9 wherein the inner surface of each bucket that is closer to said axis is convexly recessed so that the nozzle blast across each said surface upon entering the bucket provides an airfoil adding to the rotational torque developed by the rotor.

11. A pressure gas engine, comprising:

(1) an enclosing casing having a gas flow exhaust comprising gas flow outlet openings of low back pressure relative to the absolute pressure of the blast;

(2) a rotor in said casing having a circular rim defined by an outer periphery and rotatable about an axis of rotation;

(3) a single series of closely adjacent impulse buckets in said rotor at said periphery with each bucket having an entrance and exit, (a) each said bucket lying on a chord of said rim that is adjacent to a tangent of the rim that is parallel to said chord, (b) each said bucket having a tubular arcuate impulse surface of substantially constant radius transverse to the direction of rotation of said rotor, said arcuate surface extending from an entrance side of said tubular bucket located at said periphery to an opposite side of the tubular bucket also located at said periphery, (c) each said exhaust side exhausting directly into said gas flow exhaust of said relatively low back pressure;

(d) said circular rim being provided with a flat substantially square recess outwardly of, and adjacent to, each said bucket and said flat recess being located in alignment with the bucket entrance and exit sides, the square extending between the outer extremities of said entrance and exit sides of its respective bucket;

(4) nozzle means comprising an arcuate series of gas nozzles in said casing closely adjacent to said rim, each said nozzle having an axial gas passage substantially aligned with said entrance sides during rotation of the rotor for providing a high velocity blast of gas through each said nozzle, through said buckets and directly into said gas flow exhaust in a single pass through said buckets, (a) said nozzle passages being located at and substantially aligned with said bucket entrances and said nozzle means comprising blast directing means for directing substantially all of each said nozzle blasts directly into said bucket entrances for flow over said impulse surfaces and from said bucket exits, said gas blast thereby entering and leaving said rotor at said rim periphery, (b) the blast directing means including a flow directing member locating the outer boundary of each said gas blast at said periphery; and (5) means for supplying pressurized gas to all said nozzle means.

12. The engine of claim 11 wherein said gas passages converge from an entrance to an exit leading to said bucket entrances.

13. The engine of claim 11 wherein said gas passages diverge from an entrance to an exit leading to said bucket entrances.

14. The engine of claim 11 wherein said gas passages are of uniform cross section from an entrance to an exit leading to said bucket entrances.

15. The engine of claim 11 wherein said gas passages converge and then diverge from an entrance to an exit leading to said bucket entrances.

16. The engine of claim 11 wherein said gas flow outlet openings comprise means for substantially preventing gas flow restriction to said gas flow through said openings relative to the flow restriction of said blast of gas.

17. The engine of claim 11 wherein said arcuate impulse surface of each bucket extends for about 180° between its said entrance and exhaust sides.

18. The engine of claim 11 wherein said blast directing means comprises an outer wall extending from the corresponding nozzle exit toward said rotor rim.

19. The engine of claim 13 wherein said buckets are each separated from an adjacent bucket by a wall means comprising tapered edge means for dividing said blast of gas for flow into said adjacent buckets.

20. The engine of claim 19 wherein the inner surface of each bucket that is closer to said axis is convexly recessed so that the nozzle blast across each said surface upon entering the bucket provides an airfoil adding to the rotational torque developed by the rotor.

* * * * *